US006964136B2

(12) United States Patent
Collins et al.

(10) Patent No.: US 6,964,136 B2
(45) Date of Patent: Nov. 15, 2005

(54) FLASHING AND WEEP APPARATUS FOR MASONRY WALL WINDOW AND DOOR INSTALLATIONS

(75) Inventors: P. Michael Collins, Cincinnati, OH (US); Steven E. Schaefer, Cincinnati, OH (US)

(73) Assignee: PACC Systems I.P., LLC, Cincinnati, OH (US)

( * ) Notice: Subject to any disclaimer, the term of this patent is extended or adjusted under 35 U.S.C. 154(b) by 162 days.

(21) Appl. No.: 10/443,641

(22) Filed: May 22, 2003

(65) Prior Publication Data

US 2003/0230035 A1 Dec. 18, 2003

Related U.S. Application Data

(60) Provisional application No. 60/389,336, filed on Jun. 17, 2002.

(51) Int. Cl.[7] ..... E06B 7/14

(52) U.S. Cl. ..... 52/209; 52/61; 52/62; 52/204.2; 52/302.1; 52/302.3; 52/302.6; 52/378; 52/379; 52/381; 52/424; 52/404.2

(58) Field of Search ..... 52/61, 62, 204.2, 52/302.1, 302.3, 302.6, 378, 379, 381, 424, 404.2, 209

(56) References Cited

U.S. PATENT DOCUMENTS

| | | | |
|---|---|---|---|
| 1,746,816 | A | 2/1930 | Boes |
| 1,954,730 | A | 4/1934 | Erickson |
| 1,970,326 | A | 8/1934 | Larson |
| 2,122,926 | A | 7/1938 | Blacher |
| 2,147,035 | A | 2/1939 | Henderson |
| 2,154,734 | A | 4/1939 | Doing |
| 2,298,319 | A | 10/1942 | Vatet |
| 2,329,585 | A | 9/1943 | Brewer |
| 2,715,887 | A | 4/1955 | Xanten |
| 2,934,931 | A | 5/1960 | Johnson |
| 3,283,460 | A | 11/1966 | Patrick |
| 3,287,866 | A | 11/1966 | Bevilacqua |
| 3,293,810 | A | 12/1966 | Cox et al. |
| 3,445,322 | A | 5/1969 | Saila et al. |
| 3,562,892 | A | 2/1971 | Laneri |
| 3,654,765 | A | 4/1972 | Healy et al. |
| 3,668,829 | A | 6/1972 | Nelson |
| 3,754,362 | A | 8/1973 | Daimler et al. |
| 3,852,925 | A | 12/1974 | Gazzo |

(Continued)

*Primary Examiner*—Carl D. Friedman
*Assistant Examiner*—Christy M. Green
(74) *Attorney, Agent, or Firm*—Wood, Herron & Evans, LLP

(57) ABSTRACT

A flashing and weep apparatus allows for simple installation and accurate placement windows and doors in cavity wall construction. In a first embodiment, the flashing and weep apparatus is a two-panel extrusion that has a flashing panel that acts as a non-porous support for the masonry veneer. This embodiment also includes a second panel which is joined at a generally right angle to the first panel to be juxtaposed against the outer face of the inner wall in the cavity wall construction. Weep channels are formed between the two panels and allow for the drainage and dissipation of water and other moisture in the cavity wall system. In a second embodiment, membrane is initially attached to and draped along the lower portion of the inner wall immediately above the sill or lintel. The membrane extends across the cavity spacing between the walls to underlie the masonry components forming the outer veneer. Weep channels on the membrane communicate and transmit water and moisture from the cavity between the walls to the exterior of the veneer. The weep channels are positioned at the joint between adjacent bricks. The membrane extending beyond the mortar joint at the masonry veneer is trimmed during the installation process so as not to extend beyond the outer veneer wall while still providing an easily installed and implemented flash and weep system.

32 Claims, 5 Drawing Sheets

U.S. PATENT DOCUMENTS 3,888,087 A 6/1975 Bergsland
4,045,964 A 9/1977 Barclay
4,245,443 A * 1/1981 Beechen ..... 52/169.5
4,282,691 A 8/1981 Risdon
4,333,281 A 6/1982 Scarfone
4,381,630 A 5/1983 Koester
4,486,986 A 12/1984 Cosenza
4,612,742 A 9/1986 Bevilacqua
4,622,138 A 11/1986 Wager
4,704,048 A 11/1987 Ahlgrimm
4,730,953 A 3/1988 Tarko
4,745,716 A * 5/1988 Kuypers ..... 52/169.5
4,862,320 A 8/1989 Schmidt et al.
4,869,032 A * 9/1989 Geske ..... 52/169.5
4,907,385 A 3/1990 Biodrowski
4,910,931 A 3/1990 Pardue, Jr.
4,943,185 A 7/1990 McGuckin et al.
4,986,699 A 1/1991 Bohnhoff
5,044,821 A 9/1991 Johnsen
5,115,614 A 5/1992 McGrath
5,199,233 A 4/1993 Fukutomi et al.
5,218,793 A 6/1993 Ball
5,230,189 A 7/1993 Sourlis
5,263,792 A 11/1993 Davis et al.
5,274,968 A * 1/1994 Pardo ..... 52/97
5,343,661 A 9/1994 Sourlis
5,349,792 A 9/1994 Bayes
5,598,673 A * 2/1997 Atkins ..... 52/302.1
5,630,299 A 5/1997 Jackman et al.
5,644,891 A 7/1997 Kafarowski
5,692,348 A 12/1997 Ambrosino
5,694,723 A 12/1997 Parker
5,771,643 A 6/1998 Parker
5,794,388 A * 8/1998 Jackman ..... 52/169.5
5,815,986 A * 10/1998 Laska ..... 52/62
5,845,455 A 12/1998 Johnson, III
5,857,297 A 1/1999 Sawyer
5,860,259 A 1/1999 Laska
5,937,594 A 8/1999 Sourlis
6,023,892 A 2/2000 Sourlis
6,048,132 A 4/2000 Kupke et al.
RE36,676 E 5/2000 Sourlis
6,112,476 A 9/2000 Schulenburg
6,119,416 A 9/2000 Larson
6,131,353 A 10/2000 Egan
6,205,724 B1 3/2001 Garling et al.
6,224,700 B1 * 5/2001 Oakley ..... 156/71
6,238,766 B1 5/2001 Massett et al.
6,256,955 B1 7/2001 Lolley et al.
6,308,470 B1 10/2001 Durkovic
6,355,333 B1 * 3/2002 Waggoner et al. ..... 428/174
6,410,118 B1 6/2002 Reicherts et al.
2001/0023565 A1 9/2001 Snider et al.

* cited by examiner

FLASHING AND WEEP APPARATUS FOR MASONRY WALL WINDOW AND DOOR INSTALLATIONS

This claims the benefit of U.S. Provisional Patent Application Ser. No. 60/389,336, filed Jun. 17, 2002 and hereby incorporated by reference in its entirety.

BACKGROUND OF THE INVENTION

This invention relates to brick veneer/cavity wall construction and, more particularly, to a device used in association with window and door installations in a veneer/cavity wall system to provide for proper water dissipation and moisture drainage.

Walls systems having a masonry exterior are typically constructed of at least one vertical layer of masonry and at least a second vertical layer of a material forming a back-up system. The back-up system may be constructed of lumber or of a concrete masonry unit. The brick and back-up system are typically bonded together by horizontal metallic ties spaced in a vertical plane. A space is often provided in such wall systems (e.g., cavity wall systems) between the brick and back-up system for moisture drainage. Insulation may also be placed in the space to improve the energy efficiency of masonry buildings.

Masonry offers great durability and appeal. Masonry walls, however, tend to be permeable, allowing water to pass through the wall under certain conditions, such as storms associated with high winds. To solve the water leakage problem, recent construction trends have been towards a masonry wall system where the brick is intentionally separated from the back-up by a small space of from 1–4 inches. When insulation is placed in the space, an effort is made to maintain at least one inch of space between the brick and insulation for drainage.

In masonry construction using brick exteriors, it is critical to provide proper drainage in the form of a clear cavity within the wall system to prevent water related problems. A proper drainage path allows penetrating water to flow unobstructed to areas of the wall which facilitate drainage back to the exterior. This is even more important around openings in the wall for doors and windows to avoid pockets or areas the water may collect and/or drain to undesirable areas.

Masonry walls constructed with a back-up system and intervening drainage space are relatively effective and durable when guidelines are followed and drainage space is maintained. Problems often arise in construction, however, in maintaining an unobstructed space between the brick and associated back-up system. During construction, mortar often falls into the sometimes narrowed drainage space between the brick and back-up or between the brick and insulation, blocking the flow of water out of the wall interior. Additionally, discontinuities in the wall, such as openings for doors and windows, require attention to detail for the tradesman to properly provide for water and moisture handling.

Normally, the 1 to 2 inch air space provided between the brick and back-up system is adequate to provide drainage. However, in addition to mortar entering the air space during the process of brick laying, mortar extruded during the brick-laying process from the outer brick wythe also accumulates in the air space creating blockages, either falling into the air space or simply extending into and blocking the air space. Environmental debris may also fall, or blow, into the air space. Obstructions from these or other sources, either singly or together, may substantially block the flow of water out of portions of the air space. Such blockage is even more problematic in the areas surrounding windows, doors or other interruptions in the cavity wall.

When blockage of water occurs, freezing of accumulated water inside the wall may cause damage to the wall system, window or door. In masonry construction using brick exteriors, for example, it is especially important to avoid water saturation which upon freezing and thawing may lead to cracking, spalling and disintegration of masonry structures. Furthermore, penetrating water can cause efflorescence to appear on exterior surfaces or water can be transferred to the interior of the building causing mold growth, metal supports to corrode, insulation to lose its effectiveness, deterioration of the window/door and interior finishes. When the cavity is dry and air can circulate, the conditions for mold growth are minimized.

Because of the importance of masonry structures in general, a need exists for a better method of ensuring water drainage from within brick walls. Flashing and weeps are recommended by the BIA (Brick Industry Association) on all masonry window and door sill and lintel installations to direct the flow of moisture from the wall cavity and keep the underlying materials dry. Presently, a variety of materials are used such as copper, zinc, lead, stainless steel, polyethylene, polyvinylchloride, etc. Additionally, a variety of weep styles have been used. Examples of known weep systems include a length of sisal rope that is positioned atop the flashing material and in the joint between adjacent bricks at the sill or lintel of the door or window.

Unfortunately, tradesmen and installers frequently fail to install the rope or any other weep device to allow for proper drainage at the sill or lintel. The prior art does not offer an effective and economical solution that is easily and reliably installed around cavity wall windows and doors. To date, there are no known "combination materials" that provide both flashing and weep utility for sills and lintels. Simply stated, there exists a need for a combination of flashing and weep to detail sills and lintels properly to inhibit and avoid water accumulation and ineffective drainage.

SUMMARY OF THE INVENTION

This invention addresses these and other problems in the prior art and provides a unit which allows for simple installation of the flashing unit which provides the weep function for windows and doors in cavity wall construction.

Generally, disclosed herein are two embodiments of the invention that each provide a flashing and weep apparatus for use in a window installation or other interruption in the masonry wall. In a first embodiment, the flashing and weep apparatus is a two-panel extrusion that has a generally horizontal panel that acts as a non-porous support for the masonry veneer. That embodiment also includes a second and generally vertical panel which is joined at a generally right angle to the first panel to be juxtaposed against the outer face of the inner wall in the cavity wall construction. Weep chambers are formed between the two panels and allow for the drainage and dissipation of water and other moisture in the cavity wall system.

In a second embodiment of this invention, the flashing and weep apparatus is secured to the outer face of the inner wall at the sill or lintel of the door, window or other opening. Generally, this embodiment of the flashing and weep apparatus includes a rubberized membrane or substrate that is initially attached to and draped along the lower portion of the inner wall immediately above the sill or lintel. The membrane is then extended across the cavity spacing between the walls to underlie the brick or masonry components forming the outer veneer of the cavity wall construction at the door/window sill or lintel. Weep channels are provided on the membrane which, in one embodiment, comprise open cell foam pads or strips to communicate and transmit water and moisture from the cavity between the walls to the exterior of the veneer. The weep devices are positioned at joints between adjacent bricks or masonry components.

The membrane extending beyond the mortar joint at the brick or masonry veneer is trimmed during the installation process so as not to extend beyond the outer veneer wall while still providing an easily installed and implemented flash and weep system for the lintel and sill surrounding window and door openings in cavity wall construction.

BRIEF DESCRIPTION OF THE DRAWINGS

The objectives and features of the invention will become more readily apparent from the following detailed description taken in conjunction with the accompanying drawings in which.

DESCRIPTION OF THE INVENTION

Figure 1:
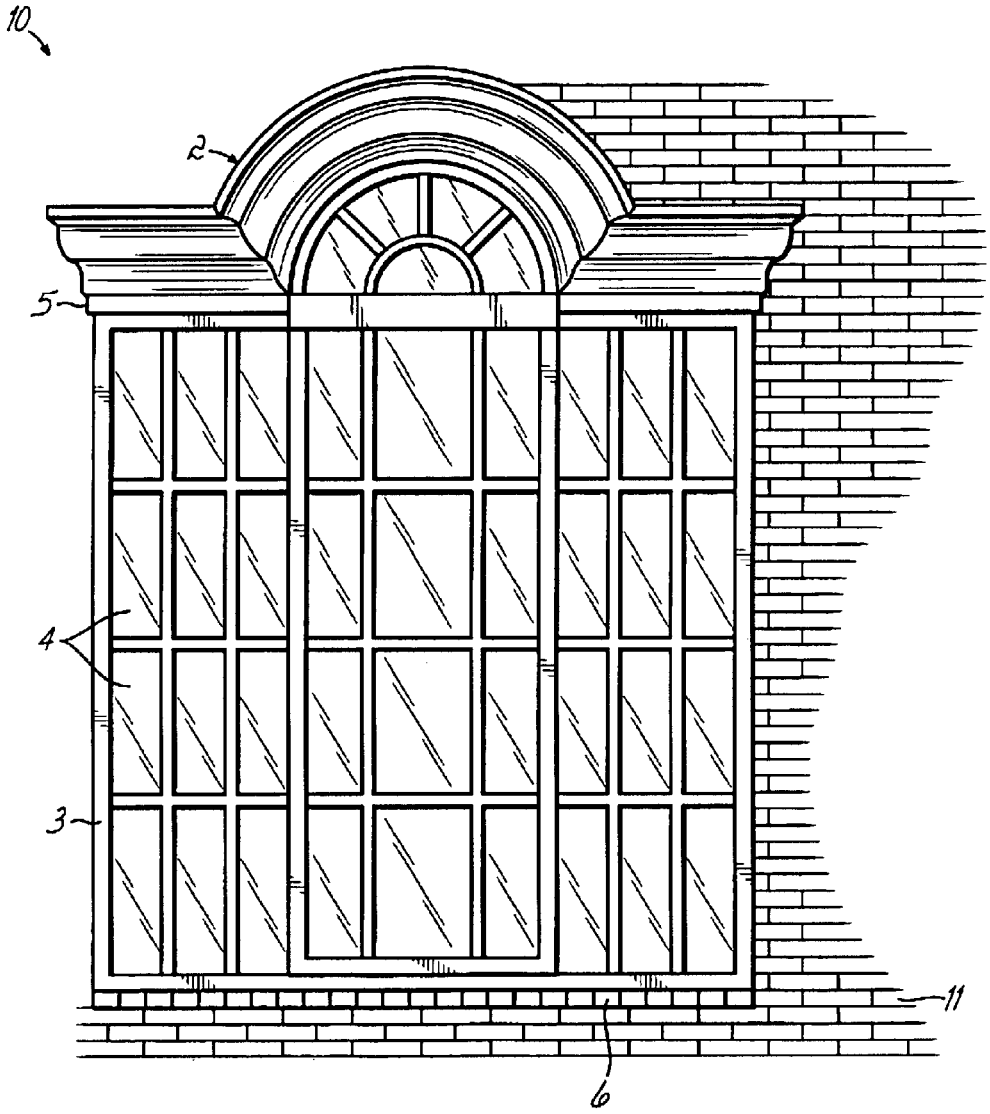
FIG. 1 is an exemplary view of a window installation in a masonry cavity wall.

Referring to FIG. 1, an exemplary window installation 2 in a cavity wall 10 is shown. The window installation 2 includes a window frame 3, window panes 4, and a lintel 5 above and a sill 6 below the window installation 2. Although one example of a window installation is shown in FIG. 1, this invention is readily applicable for a variety of window installations, doors and other openings or interruptions in the cavity wall.

Figure 2:
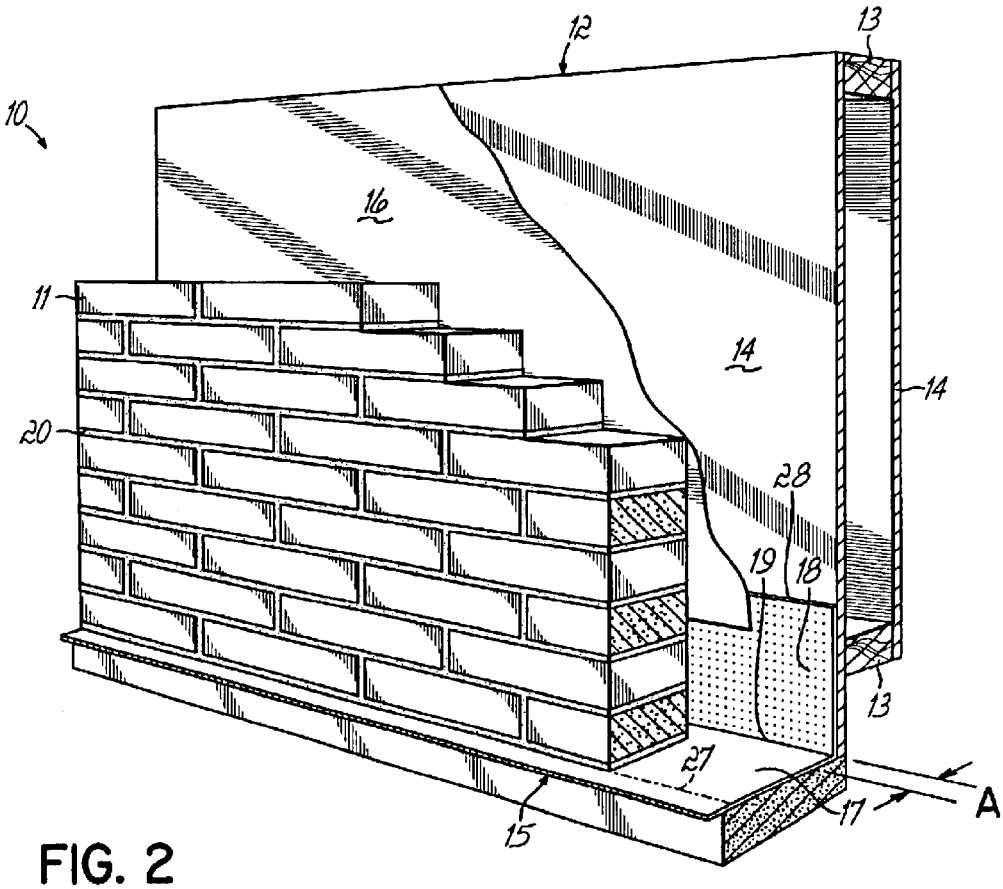
FIG. 2 is a perspective view shown partially broken away of a cavity wall construction and associated components with a flashing and weep apparatus installed at a lintel of the window of FIG. 1 according to one embodiment of this invention.

As shown more clearly in FIG. 2, the cavity wall 10 surrounding the window installation 2 in one embodiment, is comprised of a brick veneer 11 and an insulated interior wall 12. The brick veneer 11 is constructed from a plurality of bricks or blocks arranged in a pattern to construct the wall. Each brick is of a substantially rectangular shape having a uniform length, height and depth. The brick veneer 11 is built up by placing one layer of bricks over another layer, with the upper layer vertically offset from the lower layer by a distance of approximately one-half the length of a brick. Thus, as shown in FIG. 1, a brick on one layer is positioned directly over the space between two bricks on the layer immediately beneath it. The spaces between adjacent bricks and between adjacent layers of bricks are filled with mortar 20. Alternatively, the veneer 11 may be stone or other masonry components.

The insulated interior wall 12 includes wood framing 13, dry wall 14, insulation (not shown) and a weather proofing membrane 16. Of course, other materials may be used. In any event, the building wall is constructed so that there is a small cavity or airspace A between the back side of the brick veneer 11 and the outer surface of the interior wall 12. The airspace A between the back side of the brick veneer and the surface of the interior wall is usually at least about one to two inches deep, although the exact dimension may vary depending upon the nature of the construction and local building code requirements.

Figure 3:
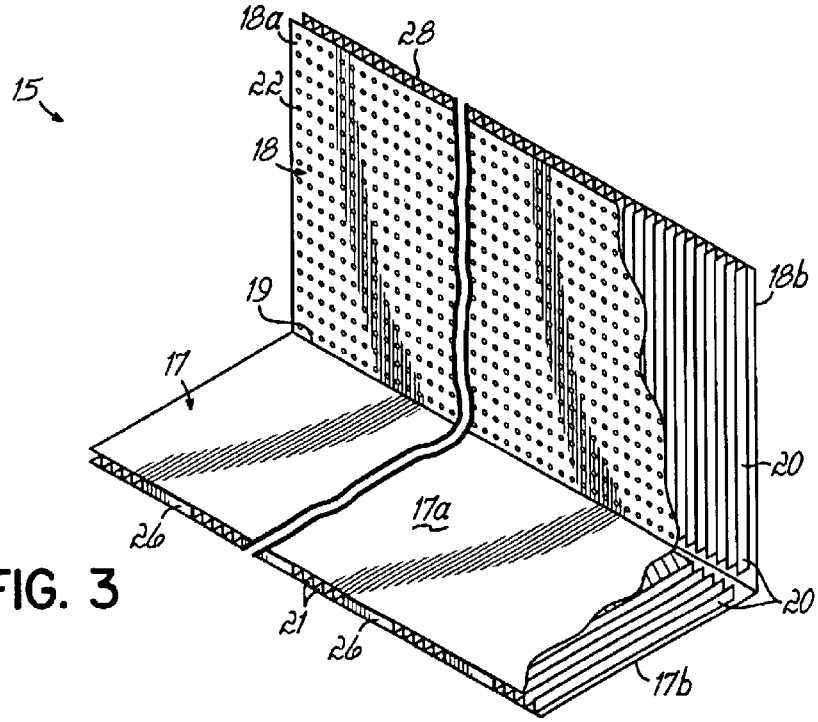
FIG. 3 is a perspective view of one embodiment of the flashing and weep apparatus of this invention.

As shown in FIG. 2, one embodiment of a flashing and weep apparatus 15 for use at a window installation 2 or other interruption in the masonry wall 10 of this invention is a two-panel extrusion that has a lower, generally horizontal flashing panel 17 including inner and outer support walls 17*a* and 17*b* (FIG. 3). The panel 17 acts as a nonporous support for the masonry veneer 11 that is placed there above. The flashing and weep apparatus 15 also has a second panel 18 having inner and outer walls 18*a*, 18*b* (FIG. 3) and being joined at a generally right angle joint 19 to the panel 17. The inner walls 17*a*, 18*a* are joined to the respective outer wall 17*b*, 18*b* by webs 20. Weep chambers 21 are formed between the adjacent walls 17*a*, 17*b*, 18*a*, 18*b* and webs 20. Preferably, the inner wall 18*a* has a series of holes 22.

The nonporous support panel 17 acts as a barrier to keep the continuous connecting cell/weep chambers 21 below clear of construction debris so that the water entering through the holes 22 of the panel 18 can exit through the continuous cell/weep chambers 21. The inner wall 18*a* has holes or perforations 22 that allow water to enter the continuous cell/weep chambers 21 below each row of perforations 22.

In the event that excess mortar 20 or other debris should fall into the airspace A behind the brick veneer 11, some of the mortar 20 may land on the very top surface 28 of the panel 17 of the flashing 15, and some mortar 20 may land on the panel 18 of the flashing 15 and accumulate upwards along the lower portion of the side of the flashing 15. However, the flashing 15 is specifically designed so that at least a portion of the inner wall 18*a* of the panel 18 remains exposed to the airspace between the back side the brick veneer 11 and the interior wall 12. Because the panel 18 and holes 22 are both air and water permeable, there will always be a pathway for draining moisture and venting air through the weep hole.

Figure 5:
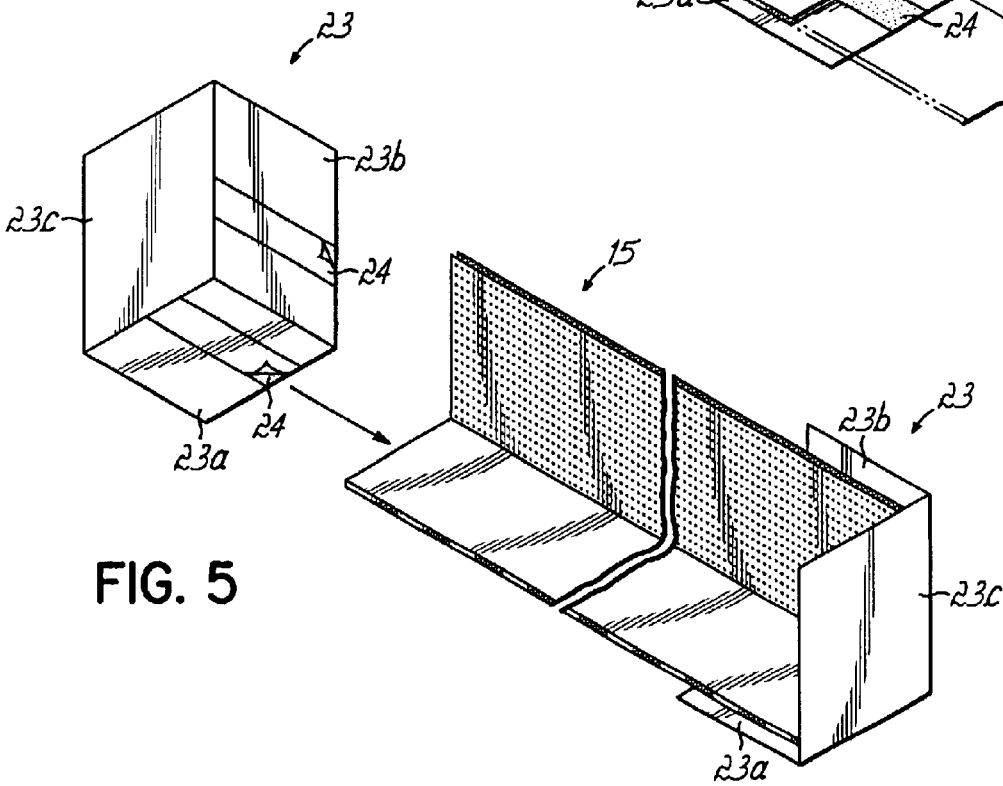
FIG. 5 is a perspective view of left and right end dams for the flashing and weep apparatus in the assembly of FIGS. 2 and 3.

As shown in FIG. 5, end dams 23 are molded plastic that have three walls 23*a*, 23*b* 23*c*, each of which are perpendicular to one another. The walls 23*a* and 23*b* are juxtaposed to the outer surfaces of walls 17*b* and 18*b*, respectively, and each have a peel-and-stick adhesive surface 24 that, when removed and pressed to the outer surfaces of the flashing unit 15, create a waterproof connection. These end dams 23 contain any water that would migrate to the end of the flashing unit 15. When contained, the water will be directed to the perforated vertical drainage wall 18*a* of the flashing unit 15.

Figure 4:
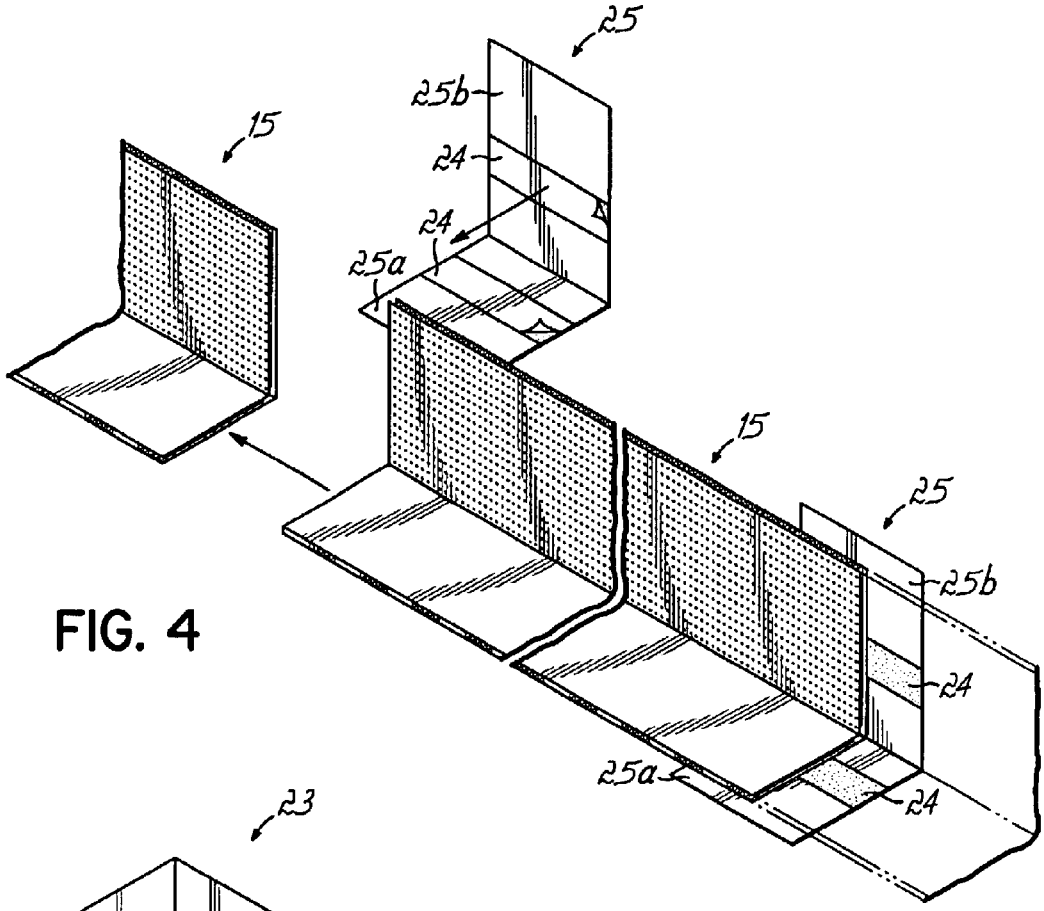
FIG. 4 is a perspective view of splicing members joining together adjacent sections of the apparatus of FIG. 3.

As shown in FIG. 4, connector or splicing members 25 allow for the extension of the flashing unit 15 to the length desired and the reuse of any cutoff material on subsequent installations. Each splicing member 25 has a pair of perpendicular walls 25*a*, 25*b* which are juxtaposed to the outer surfaces of walls 17*b* and 18*b*, respectively, of adjacent units 15. The units 15 may be provided in four foot long sections and the splicing members 25 enable the assembly of multiple units 15 for a desired length. The splicing member walls 25*a*, 25*b* include a peel-and-stick adhesive surface 24 that, when removed and pressed to the underside of the flashing unit 15, create a waterproof connection.

The flashing 15 for use at a sill of a window installation has continuous cell/weep chambers 21. Alternatively, the flashing 15 may be used on the lintel of a door or window and have intermittent cell/weep chambers 21 and support chambers 26. The reason for the different configuration in the sill flashing embodiment versus the lintel flashing embodiment is that the lintel can have substantially greater loads superimposed onto it. The support of these loads will be dealt with using solid plastic sections 26 that will be positioned at calculated intervals that allow for support of superimposed loads. The alternating continuous cell/weep chambers 21 will allow for the weeping of moisture.

The flashing 15 is made oversized to the installation so as to allow proper "fitting" to each application on the vertical plane and trimming as shown by dashed line 27 (FIG. 1) after wall completion on the horizontal plane. Likewise, the end dams 23 and splicing members 25 may be similarly trimmed as required. Done in such a manner, inspection for proper installation is easily completed on a "trim it after I see it in place" method. If it is there to be trimmed, it was installed properly.

Figure 6:
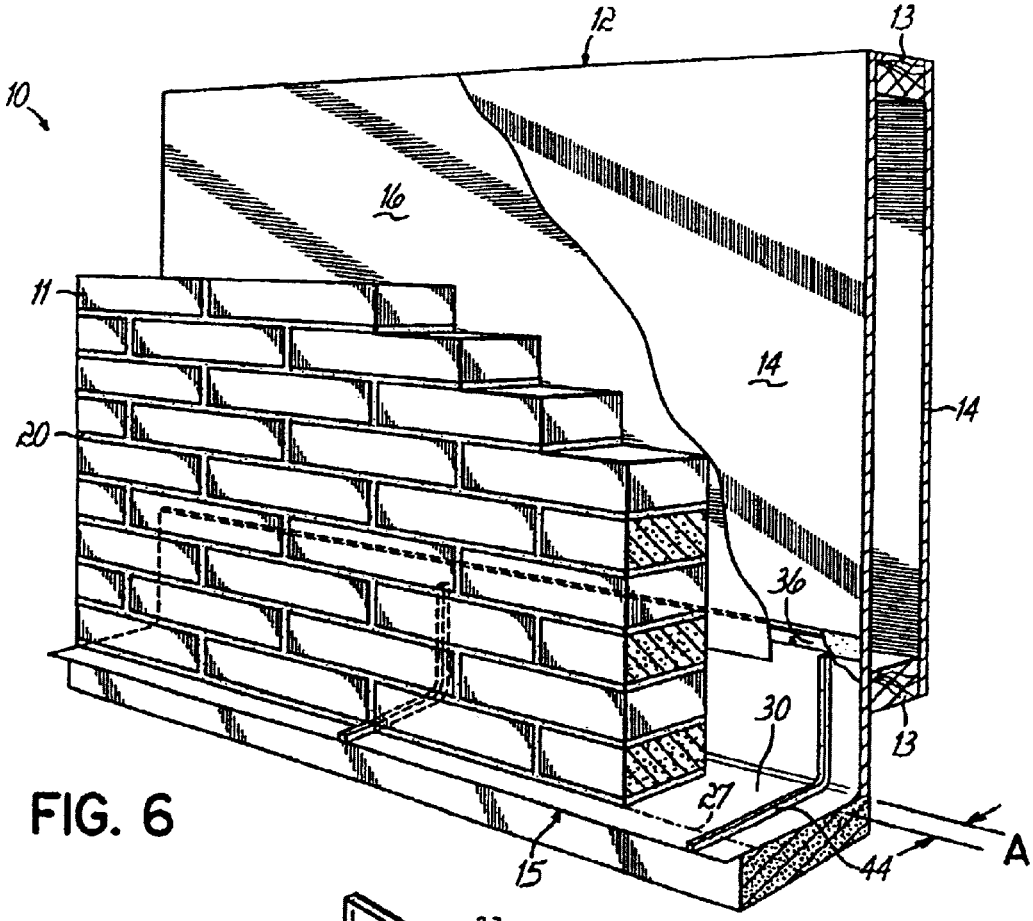
FIG. 6 is a perspective view shown partially broken away of a cavity wall construction and associated components with a flashing and weep apparatus installed at a lintel of the window of FIG. 1 according to an alternative embodiment of this invention.
Figure 7:
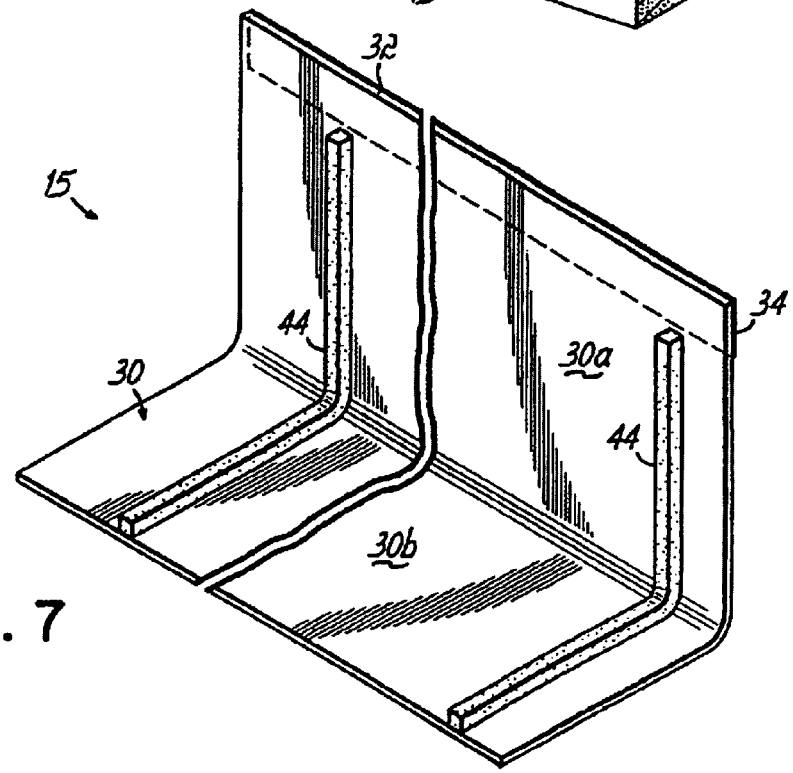
FIG. 7 is a perspective view of the alternative embodiment of FIG. 6.
Figure 8:
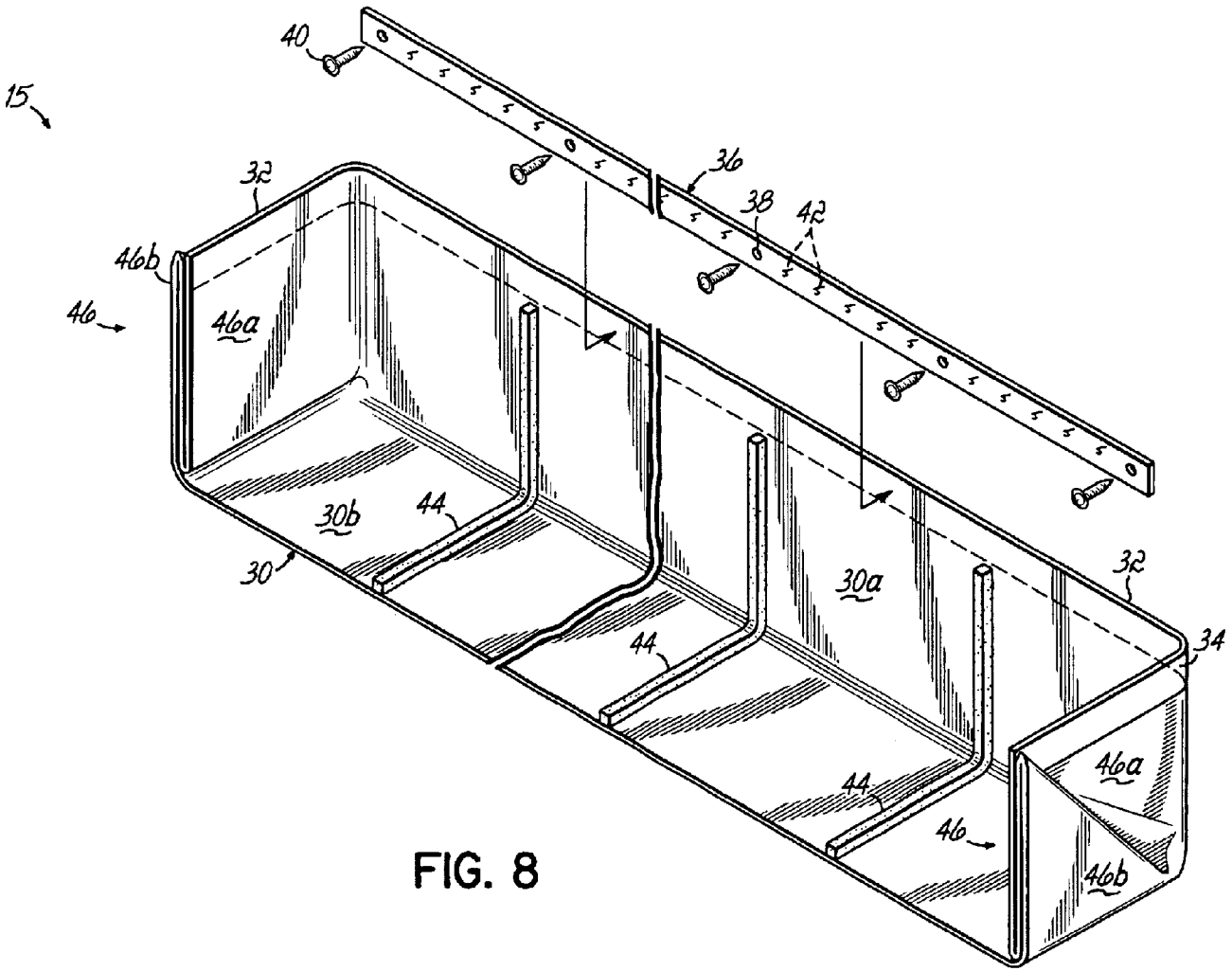
FIG. 8 is a perspective view of the alternative embodiment of FIG. 7 with left and right end dams formed in the flashing and weep apparatus.

Referring to FIGS. 6–8, a second alternative embodiment of a flash and weep apparatus 15 according to this invention is shown installed in a cavity wall construction 10 (FIG. 6) for the sill and/or lintel of a door/window installation 2. The flashing and weep apparatus 15 of this embodiment includes a substrate membrane 30 which is preferably EPDM cured rubber with a thickness of about 1/16 of an inch. The flashing and weep apparatus 15 is initially installed prior to the construction of the outer brick veneer wall 11 of the cavity wall system 10. An upper edge 32 of the substrate membrane 30 includes a mastic preferably in the form of double-sided adhesive tape 34 or the like along the back face of the substrate membrane 30. Preferably, the double-sided tape is double-coated polyethylene foam tape having a width of about 1½ inches to initially and adhesively secure the upper edge 32 of the substrate membrane 30 to the outer surface of the inner wall 12 so that the substrate membrane 30 covers the lowermost portion (preferably about 6 inches to 8 inches) of the inner wall 12. The substrate membrane 30 then laps along the sill, lintel, foundation or other support member of the cavity wall system 10 to form generally an upper portion 30*a* juxtaposed to the inner wall 12 and a lower portion 30*b* extending generally perpendicularly from the upper portion 30*a* of the substrate membrane 30. Preferably, the flash and weep apparatus 15 of this embodiment is provided in a roll of about 16 inch wide material which can be unfurled or unrolled to expose a length of substrate membrane 30 to cover the lintel or sill. The substrate membrane 30 is capable of easily being cut or severed with a utility knife, scissors or the like.

After the upper edge 32 is initially adhered to the outer surface of the inner wall 12 with the adhesive tape 34, a tacking strip 36 is applied to the outer surface of the substrate membrane 30 proximate the upper edge 32. The tacking strip 36 preferably includes a series of spaced holes or apertures 38 through which mechanical fasteners 40 such as staples, nails or screws are inserted to secure the tacking strip 36 to the inner wall 12 and project through the substrate membrane 30 and adhesive tape 34 sandwiched there between. The tacking strip 36 preferably includes a series of barbs, spurs, spikes, prongs or tines 42 to project into and engage the substrate membrane 30 and further secure the tacking strip 36 and the flashing and weep apparatus 15 to the inner wall 12.

A weep channel or spine 44 is also provided on the substrate membrane 30 of this embodiment of the flash and weep apparatus 15. Preferably, the weep channel or spine 44 is a strip of open cell deteriorating foam that is adhesively adhered to the inner surface of the substrate membrane 30 at a series of spaced locations, as shown generally in FIGS. 6–8. Preferably, the weep channels 44 are sized and positioned on the substrate membrane 30 to be located in the mortar joint 20 between adjacent bricks or masonry units in the lowermost course of the brick veneer portion 11 of the cavity wall construction 10. Preferably, the weep channels 44 are adhered to the substrate membrane 30 with non-drying adhesive so that at least the lowermost portion of the channel 44 on the lower portion 30*b* of the substrate membrane 30 can be easily repositioned for alignment with the mortar joint 20 between the adjacent bricks as is required by the tradesman or installer during the installation process. Preferably, weep channels 44 are about ½ inch high and ½ inch wide and are spaced approximately 12¾ inches from one another or other appropriate dimensions as required by proper construction practices and/or municipal building codes.

Advantageously, the open cell foam composition of the weep channel 44 provides a conduit for the escape of water or moisture trapped in the air space A between the cavity walls 11, 12 at the lintel or sill. The weep channel 44 will not be blocked by excess mortar or other debris falling on top of it in the cavity A between the walls 11, 12. The open cell foam material of the weep channel 44 may advantageously deteriorate over time thereby providing an open weep hole (not shown) in the veneer 11 of the cavity wall construction 10. Additionally, a mortar netting or similar product (not shown) may be installed in the cavity space A between the walls 11, 12 atop the flash and weep device 15 of this invention. One such product which could be used in combination with this invention is commercially available from Mortar Net USA, Ltd. (www.mortarnet.com).

Referring to FIG. 8, an end dam 46 can be conveniently formed in the flash and weep device 15 according to this embodiment of the invention by simply folding the terminal end portion of the upper panel 30*a* of the substrate membrane 30 inwardly to form an upper end dam panel 46*a*. A terminal portion 46*b* of the lower panel 30*b* of the substrate membrane 30 is then folded for juxtaposition to the outer surface of the upper end dam panel 46*a* as shown in FIG. 8. It should be readily appreciated by those of ordinary skill in the art that other end dam configurations or devices can readily be used in combination with this invention.

One advantage of the flashing and weep device 15 of this embodiment is that the membrane 30 is flaccid and bendable throughout its entire length and width. As a result, the installer can selectively position the device 15 on the inner wall 12 as desired and the juncture between the upper and lower portions 30*a*, 30*b* can be anywhere on the membrane 30 so long as the lower portion 30*b* underlies the outer veneer wall 11. This offers versatility to the device 15 for accommodating a wide range of spacing A dimensions between the walls 11, 12. The flashing 15 is made oversized to the installation so as to allow proper "fitting" to each application on the lower portion 30*b* and trimming as shown by dashed line 27 (FIG. 6) after wall 11 is completed. Done in such a manner, inspection for proper installation is easily completed on a "trim it after I see it in place" method. If it is there to be trimmed, it was installed properly.

From the above disclosure of the general principles of the present invention and the preceding detailed description of at least one preferred embodiment, those skilled in the art will readily comprehend the various modifications to which this invention is susceptible. Therefore, we desire to be limited only by the scope of the following claims and equivalents thereof.

We claim:

1. A cavity wall construction comprising:

a support member;

an inner wall extending upwardly from the support member and including an outer face;

a vapor barrier substantially covering the outer face of the inner wall to inhibit moisture from penetrating into the inner wall;

an outer wall extending upwardly from the support member, having an inner face confronting the outer face of the inner wall and being generally parallel to and spaced from the inner wall, the inner and outer walls defining a cavity there between;

wherein the outer wall is comprised of courses of masonry components held together with mortar;

a flashing located proximate an interruption in the cavity wall construction and having a first portion covering a lowermost portion of the inner wall and a second portion extending along the support member to span the cavity and underlay the outer wall, the first and second portions being generally perpendicular to each other; and a plurality of weep channels each spaced from one another, each of the weep channels extending along at least part of the first portion and at least part of the second portion of the flashing toward a terminal edge thereof;

wherein each of the weep channels is positioned in the mortar between adjacent masonry components in a lowermost course of the outer wall;

wherein water between the inner and outer walls escapes to the exterior of the cavity wall construction via the weep channels.

2. The cavity wail construction of claim 1 wherein the flashing further comprises:

an adhesive mastic proximate an upper edge of the first portion to adhere the flashing to the inner wall.

3. The cavity wall construction of claim 1 further comprising:

a tacking strip secured to the inner wall with at least a part of the first portion of the flashing interposed between the tacking strip and the inner wall.

4. The cavity wall construction of claim 3 further comprising:

a plurality of fasteners securing the tacking strip to the inner wall with the part of the flashing there between.

5. The cavity wall construction of claim 1 further comprising:

an end dam positioned at a terminal end of the flashing, the end dam having a panel oriented generally perpendicularly to the first and second portions of the flashing to contain water and direct it to one of the weep channels on the flashing.

6. The cavity wall construction of claim 5 wherein the end dam is integrally formed with the flashing.

7. The cavity wall construction of claim 6 wherein the panel of the end dam is a terminal end portion of the first portion of the flashing bent perpendicularly to a remainder of the first portion and a terminal end portion of the second portion is tucked in juxtaposed relation to the terminal end portion of the first portion of the flashing.

8. The cavity wall construction of claim 1 wherein each of the weep channels further comprises:

an open cell foam material.

9. The cavity wall construction of claim 1 wherein each of the weep channels is selectively re-positionable on the flashing prior to the construction of the outer wall.

10. The cavity wall construction of claim 9 wherein each of the weep channels is adhesively adhered to the flashing.

11. The cavity wall construction of claim 1 wherein each of the weep channels extends substantially along the entire first portion of the flashing and a substantial part of the second portion of the flashing.

12. The cavity wall construction of claim 1 wherein the flashing further comprises a cured rubber material.

13. The cavity wall construction of claim 1 wherein a ratio of the lengths of the first and second portions of the flashing is adjustable.

14. The cavity wall construction of claim 1 wherein the flashing is located proximate one of a window sill, a window lintel and a door lintel.

15. A cavity wall construction comprising:

a support member;

an inner wall extending upwardly from the support member and including an outer face;

a vapor barrier substantially covering the outer race of the inner wall to inhibit moisture from penetrating into the inner wall;

an outer wall extending upwardly from the support member, having an inner face confronting the outer face of the inner wall and being generally parallel to and spaced from the inner wall, the inner and outer walls defining a cavity there between;

wherein the outer wall is comprised of courses of masonry components held together with mortar;

a flashing having a first portion covering a lowermost portion of the inner wall and a second portion extending along the support member to span the cavity and underlay the outer wall, the first and second portions being generally perpendicular to each other;

wherein the flashing is located proximate one of a window sill, a window lintel and a door lintel;

an adhesive mastic proximate an upper edge of the first portion to adhere the flashing to the inner wall;

a tacking strip secured to the inner wall with at least a part of the first portion of the flashing interposed between the tacking strip and the inner wall;

a plurality of weep channels each spaced from one another, each of the weep channels extending along the second portion of the flashing toward a terminal edge thereof;

wherein each of the weep channels is selectively re-positionable on the flashing prior to the construction of the outer wall;

wherein each of the weep channels extends substantially along the entire first portion of the flashing and a substantial part of the second portion of the flashing;

wherein each of the weep channels is positioned in the mortar between adjacent masonry components in a lowermost course of the outer wall;

wherein water between the inner and outer walls escapes to the exterior of the cavity wall construction via the weep channels; and an end dam integrally formed with the flashing and positioned at a terminal end of the flashing, the end dam having a panel oriented generally perpendicularly to the first and second portions of the flashing to contain water and direct it to one of the weep channels on the flashing.

16. A device for use proximate an opening in a cavity wall construction having an inner wall spaced from and generally parallel to an outer wall to define a cavity there between, each wall projecting upwardly from a support member and the outer wall is comprised of courses of masonry components held together with mortar, the device comprising:

a flashing having a first portion adapted to cover a lowermost portion of the inner wall and a second portion adapted to extend along the support member to span the cavity and underlay the outer wall;

wherein the first and second portions of the flashing are adapted to be generally perpendicular to each other when installed on the cavity wall construction; and a plurality of weep channels each spaced from one another, each of the weep channels extending along at least part of the first portion and at least part of the second portion of the flashing toward a terminal edge thereof;

wherein each of the weep channels is adapted to be positioned in the mortar between adjacent masonry components in a lowermost course of the outer wall;

wherein the weep channels are adapted to transmit water between the inner and outer walls to the exterior of the cavity wall construction.

17. The device of claim 16 wherein the flashing further comprises:

an adhesive mastic proximate an upper edge of the first portion adapted to adhere the flashing to the inner wall.

18. The device of claim 16 further comprising:

a tacking strip adapted to be secured to the inner wawith at least a part of the first portion of the flashing interposed between the tacking strip and the inner wall.

19. The device of claim 18 further comprising:

a plurality of fasteners adapted to project through the tacking strip to the inner wall with the part of the flashing there between.

20. The device of claim 16 further comprising:

an end dam positioned at a terminal end of the flashing, the end dam having a panel oriented generally perpendicularly to the first and second portions of the flashing to contain water and direct it to one of the weep channels on the flashing.

21. The device of claim 20 wherein the end dam is integrally formed with the flashing.

22. The device of claim 16 wherein the panel of the end dam is a terminal end portion of the first portion of the flashing bent perpendicularly to a remainder of the first portion and a terminal end portion of the second portion is tucked in juxtaposed relation to the terminal end portion of the first portion of the flashing.

23. The device of claim 16 wherein each of the weep channels further comprises:

an open cell foam material.

24. The device of claim 16 wherein each of the weep channels is selectively re-positionable on the flashing.

25. The device of claim 24 wherein each of the weep channels is adhesively adhered to the flashing.

26. The device of claim 16 wherein each of the weep channels extends substantially along the entire first portion of the flashing and a substantial part of the second portion of the flashing.

27. The device of claim 16 wherein the flashing further comprises a cured rubber material.

28. The device of claim 16 wherein a ratio of the lengths of the first and second portions of the flashing is adjustable.

29. A method of constructing a cavity wall comprising the steps of:

erecting an inner wall;

attaching a flashing member to the inner wall proximate support member defined as one of a window sill, a window lintel and a door lintel, a first portion of the flashing member covering a lowermost portion of the inner wall adjacent the support member and a second portion of the flashing member covering the support member;

erecting an outer wall spaced from and generally parallel to the inner wall upon the support member and the second portion of the flashing member, the outer wall comprising courses of masonry components held together with mortar;

positioning weep channels on at least part of the first portion and at least part of the second portion of the flashing member and in the mortar between adjacent masonry components in a lowermost course of masonry components proximate the support member;

wherein water in a cavity between the inner and outer walls is discharged from the cavity by the weep channels; and trimming an excess part of the second portion of the flashing projecting from the outer wall.

30. The method of claim 29 further comprising:

forming an end dam in the flashing integrally joined to a remainder of the flashing.

31. The method of claim 29 further comprising:

tacking a tacking strip onto the first portion of the flashing to secure the flashing to the inner wall.

32. The method of claim 29 further comprising:

selectively repositioning selected weep channels on the second portion of the flashing to be aligned with the mortar between the adjacent masonry components in the lowermost course.

* * * * *

UNITED STATES PATENT AND TRADEMARK OFFICE

CERTIFICATE OF CORRECTION

PATENT NO. : 6,964,136 B2 
DATED : November 15, 2005
INVENTOR(S) : P. Michael Collins and Steven E. Schaefer It is certified that error appears in the above-identified patent and that said Letters Patent is hereby corrected as shown below:

Column 7,
Line 46, "cavity wail" should read -- cavity wall --.

Column 8,
Line 33, "outer race" should read -- outer face --.

Column 9,
Line 39, "inner wawith" should read -- inner wall with --.

Signed and Sealed this

Twenty-eighth Day of March, 2006

JON W. DUDAS
*Director of the United States Patent and Trademark Office*